US010962320B1

(12) United States Patent
Burdine et al.

(10) Patent No.: US 10,962,320 B1
(45) Date of Patent: Mar. 30, 2021

(54) LIGHT TRIGGER

(71) Applicants: Dorothy Devine Burdine, Ardmore, TN (US); Lavada Sue Pitts, Huntsville, AL (US)

(72) Inventors: Dorothy Devine Burdine, Ardmore, TN (US); Lavada Sue Pitts, Huntsville, AL (US)

( * ) Notice: Subject to any disclaimer, the term of this patent is extended or adjusted under 35 U.S.C. 154(b) by 0 days.

(21) Appl. No.: 16/702,364

(22) Filed: Dec. 3, 2019

(51) Int. Cl.
*F41A 19/69* (2006.01)

(52) U.S. Cl.
CPC ..... *F41A 19/69* (2013.01)

(58) Field of Classification Search
CPC ..... F41A 19/69; F41A 19/58; F41A 19/59; F41A 19/60–63; F41A 19/70
USPC ..... 42/84, 41
See application file for complete search history.

(56) References Cited

U.S. PATENT DOCUMENTS 3,526,775 A * 9/1970 Friedrich ..... H03K 17/968 250/221
4,134,223 A * 1/1979 Hillenbrandt ..... F41A 19/59 42/84
4,275,521 A * 6/1981 Gerstenberger ..... F41A 19/58 42/84
4,429,612 A * 2/1984 Tidman ..... H05H 1/54 89/8
4,757,629 A * 7/1988 Austin ..... F41A 19/59 42/84
5,541,397 A * 7/1996 Walts ..... G06K 7/10881 235/462.48
6,464,554 B1 * 10/2002 Levy ..... A63H 5/04 250/221
2018/0245869 A1 * 8/2018 Marin ..... F41A 19/58
2020/0386504 A1 * 12/2020 Tubb ..... F41A 19/63

* cited by examiner

*Primary Examiner* — John Cooper
(74) *Attorney, Agent, or Firm* — Dennen IP Law, LLC

(57) ABSTRACT

An optical firearm trigger is disclosed, revealing means and methods of initiating discharge of a firearm without the use of a mechanical trigger. In this manner the grip of the firearm will not change due to the mechanical loading required to pull the trigger further alleviating the hold, or squeeze, on the firearm during discharge. It further relates to firearm safety as it provides methods and means to prevent reflexive, unintentional trigger pull by the shooter. No personalization or additional security is incorporated in the firearm by this disclosure.

18 Claims, 14 Drawing Sheets

LIGHT TRIGGER

FIELD OF THE INVENTION

An optical firearm trigger is disclosed, revealing means and methods of initiating discharge of a firearm without the use of a mechanical trigger. In this manner the grip of the firearm will not change due to the mechanical loading required to pull the trigger further alleviating the hold, or squeeze, on the firearm during discharge. It further relates to firearm safety as it provides methods and means to prevent reflexive, unintentional trigger pull by the shooter. No personalization or additional security is incorporated in the firearm by this disclosure.

DISCUSSION OF THE PRIOR ART

Present day firearms are typically initiated with a mechanical trigger. A trigger for a firearm is part of a mechanism that actuates the discharge sequence of the firearm. A small amount of energy applied to the trigger causes a chain of events that results in the release of a much greater energy imparted to a projectile commonly known as the bullet. This action is known as firing or discharging the firearm.

The pull on the trigger required to fire the firearm, sometimes referred to as squeezing off the shot, mechanically loads the firearm and must be compensated by the grip on the firearm to maintain aim. Trigger control is widely considered to be one of the most crucial shooting fundamentals.

There are five common trigger action types in current use.

First is the Single Action Only (SAO) trigger. A SAO trigger performs the single (only) action of releasing the hammer or striker to fire the firearm each time the trigger is pressed. If the hammer is not cocked on a SAO firearm, pressing the trigger will result in no shot being fired. The SAO is considered the simplest action with the shortest, lightest, and smoothest press. The press, typically four pounds, is more consistent from shot to shot facilitating minimal adjustments in technique being necessary for good accuracy.

Second is the Double Action (DA) trigger. DA indicates that pressing the trigger causes two (double) actions at the same time: (1) cocking and (2) releasing the hammer. DA triggers provide the ability to fire the firearm whether the hammer is cocked or not. This feature has proven attractive for police, military, and self-defense shooters. One disadvantage of any DA trigger is the extra length the trigger must be pressed and the extra trigger press required to overcome the spring tension of the hammer or striker.

Third is the Double Action Only (DAO) trigger. DAO firearms cannot be fired in SAO mode. DAO firearms cannot be manually cocked, since the hammer is only cocked and released by trigger manipulation. The hammer will not be automatically cocked after a shot is fired. It returns to a de-cocked position after each shot. DAO revolvers are seemingly hammerless, so they cannot be manually cocked and shot in single action. Trigger control is especially important with a DAO as the length and force of the trigger press is crucial. Trigger control deviations and erratic movements tend to amplify errors.

Fourth is the Double Action/Single Action (DA/SA) trigger. This type of trigger is found on many semi-automatic DA/SA pistols. The first shot can be double action or single action, depending on whether the trigger is pressed initially for double action or if the hammer is manually cocked back with the thumb for single action, but one press of the trigger does cock and release the hammer if it is not cocked manually. If the hammer is manually cocked, the pressing of the trigger will release the hammer. Semi-automatic DA/SA pistols are typically re-cock by the slide after the firearm is fired. With a DA/SA type of firearm, all subsequent shots after the first DA press will be fired single action until shooting stops and the hammer is de-cocked. A DA/SA firearm is always ready to fire as soon as the trigger is pressed with no need to disengage a safety. DA/SA firearms have a first press of the trigger between 8-12 pounds (DA). The second trigger press typically ranges from 4 to 6 pounds.

Fifth is the Striker Fired/Partially Cocked (SF) trigger. SF firearms are neither DAO nor SAO trigger mechanisms. They are striker fired with their own system, trigger safeties and striker blocks. In SF pistols, the trigger engages the firing pin directly through a linkage rather than by engaging and releasing a hammer to fall against the firing pin. As the trigger is pulled the striker bar is drawn rearward and eventually released. The end of the striker acts as a firing pin and strikes the primer firing the firearm. The slide cocks the striker and then the trigger completes the other half of the cocking action releasing the striker. A typical trigger press is between 5 to 7 pounds.

A trigger pull weight of less than four pounds is considered hazardous for many applications though some specialty triggers provide pull weights of as little as two pounds.

Many attempts have been made to reduce the trigger pull required to fire the firearm. The goal is to improve shooter precision while at the same time maintaining a sufficient pull requirement to maintain safety. The present disclosure reduces the pull weight to zero allowing for the improvement of shooting accuracy while at the same time providing improved safety by removing the mechanical trigger. Another issue addressed by the present disclosure is the accidental firing of a firearm by reflexive squeezing of the trigger.

There are many well known incidents of the involuntary discharge of a firearm caused by known trigger pull issues. These trigger pulls are sometimes caused by sympathetic contraction of the hand holding the firearm due to such things as loss of balance, reflexive reaction to a loud noise, or by another startling reaction all initiating discharge of the firearm by unintentionally squeezing the trigger. Sympathetic contraction refers to an involuntary contraction occurring in the muscles of one limb when the same muscles in the other limb are performing an intended forceful action. This effect is known as a mirror movement, with the intensity of the sympathetic contraction depending on the amount of force exerted during the intended action. In policing, a common situation causing such a sympathetic contraction might be a law enforcement officer attempting to restrain a struggling suspect with one hand while holding a firearm such as pistol in the other, the sympathetic contraction discharging the firearm. Significant training and safety instruction are often provided to police and others to avoid these unfortunate incidents, yet they still occur.

Another scenario involves loss of balance. When balance is disturbed a rapid involuntary contraction occurs to aid in the return to a position of equilibrium. When a person is holding a handle for support there is a tendency to use the arm muscles to maintain balance rather than the leg muscles. Under such circumstances the focal point of regaining balance is any contact point an individual has with their surroundings. If a person starts to fall while grasping a handheld firearm, the person is likely to grasp it more forcefully accidentally discharging the firearm.

Another well-known phenomenon is a whole-body response to an unexpected stimulus such as a loud noise. This reflex causes rapid involuntary contractions that spread to all muscles of the body. The reaction of the hands typically occurs less than 200 ms after the stimulus and leads to an individual clenching their fists. In this manner an officer startled by a loud, unexpected noise while searching for a suspect with the firearm drawn may increase the grip force on the firearm and cause an involuntary discharge.

The present disclosure provides a firearm initiation methodology that directly address the accidental trigger pull issue by removing the need to pull a trigger to discharge the weapon.

Prior art reveals a method of initiating a firearm when a beam of light is broken by the shooters finger, or by completing the light beam to the receiver by reflection of the beam from the shooters finger. Both methods are flawed as they do not require consistent action by the shooter to facilitate the action as no fixed relationship is made between the beam to be broken or reflected and the starting position of the finger. Reflection of the beam off a shooters finger is dependent on the particular circumstance of the shooters finger and may not be consistent from shot to shot. The present disclosure initiates the firearm upon receipt of a previously blocked beam through the action of a finger moving from a defined beam blocking position in a defined manner to a position no longer blocking the beam. In this way the beam illumination is consistent and reliable. The finger action may be either forward, away from the shooter, or backward, towards the shooter as desired for the specific application. Further, prior disclosure reveals a pulling action to interrupt the light beam. The present disclosure discloses moving the trigger finger forward or backward to unblock and complete the light beam initiating discharge. In the manner of the finger moving forward unintended discharge is eliminated.

For the present disclosure the beam is a source of divergent radiant energy to include light radiating from a source. The energy is considered to be shaped or otherwise constrained or manipulated as per the desired application with the radiant energy from certain types of laser having the smallest beam divergence. For the present disclosure it is preferred that the beam be any form of energy emission as facilitates a particular application.

The present disclosure does not require the use of a mechanical trigger to initiate a firearm. A light beam is detected in the manner herein described to initiate firing. In this manner mechanical loading of the firearm by the mechanical trigger pull is avoided. Safety is further provided maintained by the shooters control and knowledge of the fire/no-fire condition of the firearm and the ability to fire the firearm by finger extension rather than contraction, avoiding unintentional firing of the firearm by reflexive contraction of the trigger finger. The present disclosure is not a smart firearm as it does not incorporate a safety feature or features that allow it to fire only when activated by an authorized shooter. Any shooter can operate the present disclosure without authorization just as any common firearm.

SUMMARY OF THE INVENTION

This disclosure relates to the firing of a firearm through use of an optical trigger. The firearm is initiated by the completion of an optical signal by the shooter in the manners herein disclosed. In this way the firearm's aim is not affected by the loading of a mechanical trigger to initiate a discharge. This embodiment gives the present invention a distinct advantage not only in common use but also when used in high precision activities such as long-range hunting and military applications.

This disclosure further relates to shooter safety by the avoidance of unintentional discharge of the firearm through provision of methods and means of avoiding the reflexive and involuntary contraction of the trigger finger squeezing a mechanical trigger initiating discharge of the firearm.

Unless otherwise defined, all terms (including trade, technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and relevant art, and should not be interpreted in an idealized or overly formal sense unless expressly so defined herein. Well known functions or constructions may not be described in detail for brevity and/or clarity. The terms gun, weapon, firearm and firearms are used interchangeably.

BRIEF DESCRIPTION OF THE DRAWINGS

The invention will now be described with reference to the accompanying drawings in which.

DETAILED DESCRIPTION OF THE INVENTION

Illustrative embodiments of the invention are herein described. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having benefit of this disclosure.

The solution provided by this disclosure is the elimination of shooting inaccuracy due to the mis-pointing of the firearm imparted by forces introduced to the firearm through the mechanical action of pulling a trigger. This distortion of the aim is addressed by removing the requirement for the mechanical action, the pulling of the trigger, to discharge the firearm. Issues with the trigger pull and related grip pressure are greatly reduced or eliminated by the present invention. This disclosure further relates to shooter safety through the avoidance of unintentional discharge of the firearm by the provision of methods and means avoiding the reflexive and involuntary contraction of the trigger finger squeezing a mechanical trigger and initiating discharge of the firearm.

In regard to the following description of the Figures, the terms and their preferred embodiments follow.

Figure 1:
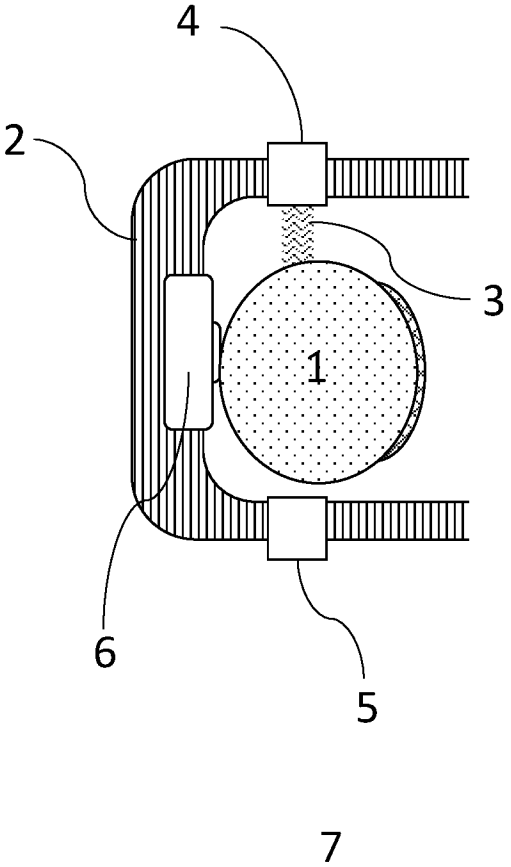
FIG. 1 illustrates the principal components of an aspect of the present invention together forming the Trigger Assembly 7 with Finger 1 shown.

FIG. 1 illustrates the principal components of an aspect of the present invention comprising Trigger Assembly 7. Trigger Assembly 7 is comprised of individual components including a Shield 2, Fire 3, Emitter 4, Receiver 5, and Switch 6. A Finger 1 is shown resting against the Switch 6 blocking Fire 3 from being incident upon Receiver 5, Finger 1 having pressed Switch 6 initiating the function of Trigger Assembly 7 causing the Emitter 4 to emit Fire 3. The Finger 1 is shown pointing out of the frame of reference towards the reader, the fingernail shown on the top of the Finger 1 and away from Switch 6. The position of Finger 1 is established upon pressing Switch 6 to activate or deactivate Fire 3.

Shield 2 is a structural component providing mounting means for other components and providing means for the mounting of the complete assembly known as Trigger Assembly 7 to the firearm. Shield 2 serves the same purpose as a trigger guard in a typical firearm. It also serves to maintain alignment of the Emitter 4 and Receiver 5, and to maintain location and offer some mechanical protection to Switch 6. The Shield 2 is shown in both open though closed configurations are a preferred embodiment and is preferred to be configured in any manner as suits the present disclosure's implementation requirements.

Fire 3 is a radiated energy radiated by Emitter 4 in any energy or frequency as desired and is received by Receiver 5. Emitter 4 is preferred to be a light-emitting diode (LED) semiconductor light source releasing energy in the form of photons. LEDs are available across the visible, ultraviolet, and infrared wavelengths with very high brightness and are all preferred embodiments of the present invention.

Laser diodes, to include injection laser diodes or diode lasers, are a preferred embodiment of the present invention. These constitute semiconductor devices similar to a light-emitting diode in which a diode pumped directly with electrical current generates lasing conditions at the diode's junction emitting laser light.

Fire 3 is referenced herein as being blocked or unblocked. When Fire 3 is blocked it is emitted by Emitter 4 but does not reach Receiver 5. When Fire 3 is unblocked it is emitted by Emitter 4 and is received by Receiver 5. The logic or state or action generated or not generated is a particular of the configuration being described.

Receiver 5 is preferred to be a photodiode or phototransistor as best suited to receive the Beam 3 from Emitter 4. In the case where a transistor is preferred for the Receiver 5, the Receiver 5 is preferred to be an NPN (Negative, Positive, Negative) or PNP (Positive, Negative, Positive) transistor as best facilitating Electronics 20 (not shown) and biased by the incoming light from Emitter 4. Receiver 5 is preferred to be equipped with a filter allowing only the frequency of the signal generated by Emitter 4 to be detected by Receiver 5.

A preferred method for the Emitter 4 and Receiver 5 to further secure the signal to discharge the Firearm 12 is asynchronous serial communication. In this form of serial communication, the communicating Emitter 4 and Receiver 5 are not synchronized by a common clock signal, but by the data stream containing synchronization information in the form of start and stop signals. The carrier frequency for this method is typically somewhere between 33 to 60 kHz, with the most common carrier frequency in commercial and consumer use being 38 kHz. This method is well supported by fully developed and readily available electronic components and software. In this method the Emitter 4 and Receiver 5 are preferred to operate in the infrared (IR) and facilitate an analog to digital conversion allowing variable readings to be collected from the Receiver 5. The Emitter 4 may typically be driven up to 50 mA, though much lower signal strengths are preferred for the present disclosure to economize on energy usage as the distance between the Emitter 4 and Receiver 5 is very small as compared to more typical applications. In this manner stray light such as sunlight or other high intensity sources are prevented from interfering with the operation of the Trigger Assembly 7.

It is a preferred embodiment that Fire 3 be any form of electromagnetic, optical or mechanical emission of any frequency, form, wavelength, pulse or intensity as facilities a particular application of the present disclosure.

Figure 2:
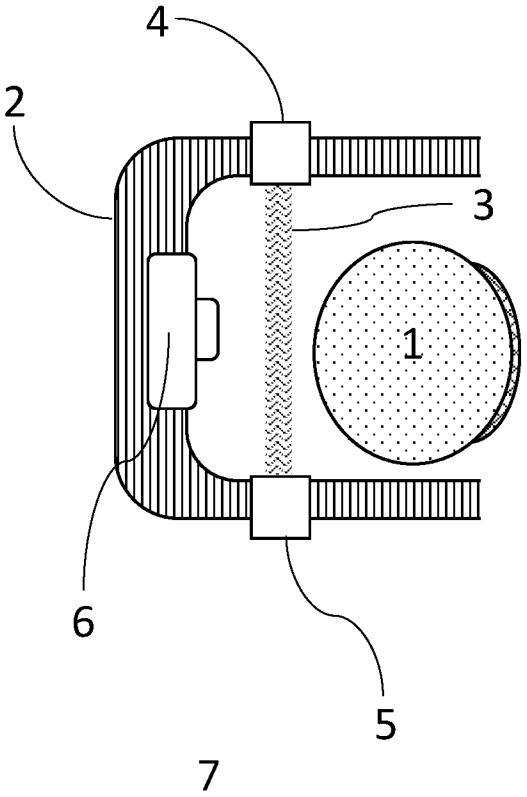
FIG. 2 further illustrates the principal components of Trigger Assembly 7 with Finger 1 shown moved to the right.

Emitter 4 generates and emits a signal to be received by Receiver 5, but in this case is blocked by Finger 1. When Finger 1 moves to the right, as per the FIG. 2 illustration, and upon the acquisition of the Fire 3 by Receiver 5 the Firearm 12 (not shown) receives a signal from Trigger Assembly 7 promoting discharge or other actions as preferred. The reception of the Fire 3 beam generated by Emitter 4 and received by Receiver 5 is preferred to complete the act of discharging the weapon.

It is a preferred embodiment to coat the visible elements of the present invention with dark, low reflectivity materials to avoid Emitter 4 emissions being detectable by others observing the Trigger Assembly 7. Ultra-black materials such as VANTA (vertically aligned carbon nanotube arrays are a current type of material comprising one of the darkest substances known, absorbing up to 99.965% of visible light) and similar are a preferred embodiment of the present invention. This functionality is assumed applicable in all implementations of the present invention as required for the desired application.

Switch 6 is a switch that is toggled between closed and open when pressed by the shooter. Alternatively, Switch 6 may be a momentary contact switch that toggles the Electronics 20 (not shown) between an active state in which the Firearm 12 may discharge or an inactive state in which the Firearm 12 cannot discharge. It is a further preferred embodiment that Switch 6 be of any geometric form and surface characteristic as desired for the particular application. When Switch 6 is a toggle switch in a closed position the Firearm 12 may be operated by the action of Trigger Assembly 7. When Switch 6 is not pressed into a closed position and is open the Trigger Assembly 7 will not operate and the Firearm 12 will not discharge.

It is a preferred embodiment of the present invention that Switch 6 switches Fire 3 between on and off on each press by Finger 1. Switch 6 is preferred to be any type of state selection device to include a switch to further include electrical, electronic, mechanical, pressure, optical or other switch suitable for the sensing and signaling or realization of the desired state change of the Trigger Assembly 7.

It is a further preferred embodiment that Switch 6 provide a suitable interface with Finger 1 to include sufficient mechanical or other press force to avoid unintentional toggle, and that Switch 6 provide suitable feedback to Finger 1 in the form of tactile or other sensory manner to assure operation is confirmed to the shooter.

It is a preferred embodiment that all Trigger Assembly 7 and all related components in any configuration be further attached to an electrical power source and that power source be further comprised of a battery or battery pack.

When Finger 1 is initially placed in Shield 2, the Firearm 12 is in a no discharge condition. The Finger 1 presses Switch 6 and places Firearm 12 into a discharge condition causing Emitter 4 and Receiver 5 to become active and the beam Fire 3 to be emitted by Emitter 4. The Finger 1 is in an initial position as per the present disclosure to block the beam Fire 3 from reaching Receiver 5 and the Firearm 12 does not discharge.

It is a preferred embodiment that an option be available such that the Switch 6 being pressed by Finger 1 initiates a time period in which Finger 1 may unblock Fire 3 and cause discharge of the firearm. If the time period initiated by Switch 6 expiries before Fire 3 is unblocked the ability to cause discharge of the firearm is disabled.

It is a preferred embodiment that Trigger Assembly 7 be used in a reverse manner to the present description. In this manner the nail of Finger 1 is on the side of the Switch 6 and retracts in order to unblock Fire 3 and discharge Firearm 12. In this manner the typical motion of pulling the trigger is maintained while still avoiding the loading of the trigger during the act of discharging the Firearm 12. This is herein referred to as a pull trigger method and is a preferred embodiment of the present invention.

FIG. 2 further illustrates the principal components of an aspect of the present invention incorporated into the Trigger Assembly 7. It is comprised of individual components including a Shield 2, Fire 3, Emitter 4, Receiver 5, and Switch 6, collectively known as Trigger Assembly 7. A Finger 1 is shown having moved to the right in Trigger Assembly 7 away from resting on Switch 6 no longer blocking the Fire 3 beam from being incident on the Receiver 5. Upon the Fire 3 being incident on the Receiver 5, the Trigger Assembly 7 sends a command to the Firearm 12 (not shown) to discharge. This is herein referred to as a push trigger.

Initially Finger 1 presses Switch 6 and the Trigger Assembly 7 becomes active. The Emitter 4 emits the Fire 3 beam and the beam is blocked from reaching Receiver 5 by Finger 1. Firearm 12 (not shown) does not discharge as long as Fire 3 is blocked. When Finger 1 moves to the right as shown in FIG. 2 and Fire 3 becomes incident on the Receiver 5, the Trigger Assembly 7 sends a command to the Firearm 12 to discharge. The Trigger Assembly 7 may be configured to discharge Firearm 12 every time the Fire 3 beam is unblocked. This discharge of Firearm 12 may be selected, either by the shooter or by factory settings, to discharge once or multiple times on every blocking or unblocking of Fire 3 by Finger 1, and also to discharge one or more times on the receipt of Fire 3 by the Receiver 5 after the initial blocking of Fire 3 by Finger 1 preventing Fire 3 from illuminating Receiver 5. In this and other manners the Firearm 12 discharge is fully configurable allowing all possible discharge options to be accommodated by Trigger Assembly 7. When Finger 1 unblocks Fire 3 and Firearm 12 is configured to continue firing as long as Fire 3 is not blocked by Finger 1 the Firearm 12 acts in full-auto mode as in conventional firearms.

All logical functionality of Trigger 7 is controlled by Electronics 20 (not shown) that may be integrated into or separate from Trigger 7 as per the desired implementation.

When the Switch 6 is again pressed the Fire 3 beam shuts down and the Trigger Assembly 7 remains inactive until the Switch 6 is again pressed.

Switch 6 may incorporate any type of switch technology including push on/off mechanical switches, or may provide contact only input to Electronics 20 (not shown). Switch 6 is preferred to be an electrical switching device actuated by the presence or action of Finger 1 in a preferred manner.

The Shield 2 is preferred to be sized to accommodate Finger 1 touching Switch 6 during discharge of Firearm 12 when Finger 1 is pressing Switch 6 turning the Trigger Assembly 7 on or off.

It is a preferred embodiment that upon discharge of Firearm 12 the Emitter 4 cease emission of Fire 3 until the Switch 6 is again pressed. In this manner the Firearm 12 is prevented from unintentional discharge.

Figure 3:
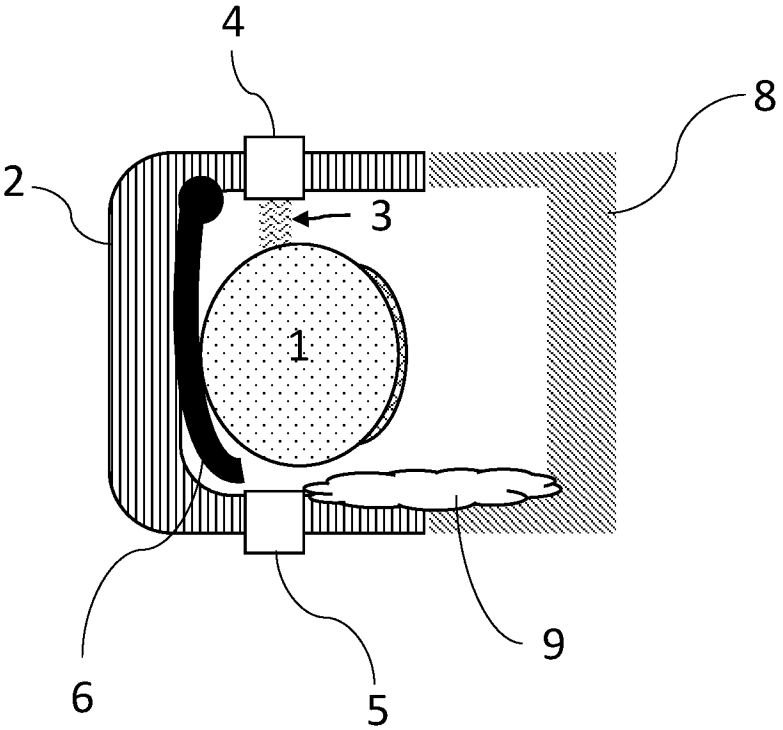
FIG. 3 further illustrates the principal components of Trigger Assembly 7 with Switch 6 shown in the form of a conventional trigger.

FIG. 3 illustrates the principal components of an aspect of the present invention incorporated into the Trigger Assembly 7. It is comprised of individual components including a Shield 2, Fire 3, Emitter 4, Receiver 5, Stop Bar 8 and Switch 6 collectively known as Trigger Assembly 7. A Finger 1 is shown resting against a Switch 6 blocking Fire 3 from being incident upon Receiver 5. Switch 6 is in the form of a conventional firearm trigger to accommodate feel for the shooter.

It is a preferred embodiment of the present invention that Switch 6 be configurable as a conventional firearm trigger in both shape, surface and surface features. It is a further embodiment of the present invention that Switch 6 be provided in a number of shooter contact shapes and configurations and be both factory installed or field replaceable as desired.

Texture 9 is a preferred embodiment to provide the shooter with tactile feedback for the position of Finger 1 in relationship to Fire 3. The Texture 9 is preferred to be a surface characteristic of the material of Shield 2 such as a surface roughness, or an added surface such as a cloth, metal grain, sponge or other material. The Texture 9 may also be comprised of raised three dimensional elements including items such as flaps or feathers. The Texture 9 provides feedback and control of the Finger 1 to the shooter for control of the Finger 1 position within the Shield 2. This functionality is assumed applicable in implementations of the present invention as required.

Stop Bar 8 is an extension of Shield 2 that is preferred to be configurable to restrain the freedom of motion of Finger 1. Stop Bar 8 is a removeable extension of Shield 2 as desired for the particular implementation. Stop Bar 8 is preferred to be equipable with all implements and extensions applicable to Shield 2 in a removeable implementation.

Figure 4:
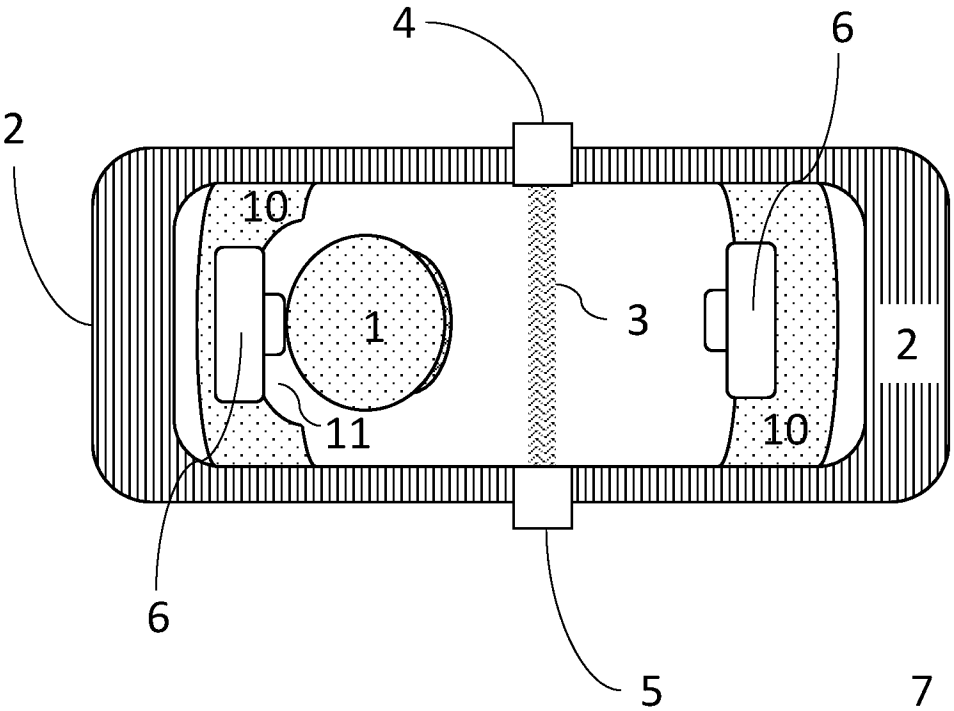
FIG. 4 illustrates a further aspect of the present invention incorporated into the Trigger Assembly 7 as a blocked then unblocked beam from a fixed starting posotion triggering system.

FIG. 4 illustrates further aspects of the present invention incorporated as the Trigger Assembly 7. Here Trigger Assembly 7 is comprised of individual components including Shield 2, Fire 3, Emitter 4, Receiver 5, Finger Arm Position 11, two each Switch 6 and two each Switch Adjust 10. Finger 1 is shown resting against the left Switch 6. The Finger 1 is shown pointing out of the frame of reference towards the reader, the fingernail shown on the top of the Finger 1 and towards Fire 3.

Finger 1 is shown contacting the left Switch 6 establishing finger position. Left Switch 6 is mounted in the Finger Arm Position 11 in the left Switch Adjust 10. The left Switch Adjust 10 incorporates Finger Arm Position 11 recessing Switch 6 for improved location and control by Finger 1. The Finger 1 may further utilize right Switch 6 to activate Fire 3 and move to the left to actuate Fire 3. Fire 3 is canted in Shield 2 facilitating Fire 3 block or unblock configuration. Initially the Fire 3 beam is inactive and Trigger Assembly 7 will not cause a discharge of the firearm. When Finger 1 presses either of the two Switch 6 the Fire 3 beam becomes active. The position of Finger 1 is established and repeatably consistent within Trigger Assembly 7 upon the pressing of a Switch 6. In this manner the shooter has a fixed reference from which to base all Finger 1 movements within Trigger Assembly 7.

The two Switch Adjust 10 are preferred to be fixed in position or adjustable within Shield 2, defining the range of motion for Finger 1. Each Switch Adjust 10 may be together or independently made from any desired material or combination of materials to include metals, plastics, and organic materials such as wood, and further coated as desired for the particular implementation of the present disclosure for improved interface with Finger 1. As an example, one or both Switch Adjust 10 may be a metal, or other materials such as a Polymer-Ceramic coated with a ceramic coating to enhance physical performance properties including abrasion/wear resistance, corrosion resistance, chemical resistance, impact strength, and hardness. Shield 2 and other components of Trigger Assembly 7 are preferred to be fabricated and surfaced in a similar and/or complementary manner to facilitate the desired operation.

The motion of Finger 1 causing discharge as shown when moving forward is opposite the squeezing motion usually associated with the operation of a firearm's trigger. In this embodiment Finger 1 moves to block Fire 3, initiating discharge. Finger 1 may start at either end of Trigger Assembly 7 and in this manner inherent safety, improved accuracy and shooter preference are all provided by the present invention. The position of Finger 1 being repeatably and consistently determined for the shooter in relationship to Fire 3 provides the opportunity for consistency in the shooters control of the discharge similar to a mechanical trigger in a conventional firearm without requiring any pull force.

The two Switch Adjust 10 may be fixed in Shield 2 as suits the implementation of the present disclosure but are otherwise preferred to be together or independently adjustable within the Shield 2 to accommodate the preference of the shooter. Switch Adjust 10 is preferred to slide for positioning or otherwise be positionable within Shield 2 and to be firmly positioned by means such as a fastener or slide stop as desired. Once each Switch Adjust 10 is positioned, the shooter is provided with suitable start and stop positions for Finger 1 with interruption of Fire 3 being convenient for the implementation of the present disclosure. The two Switch Adjust 10 define the range of motion for Finger 1.

It is noted that some firearms may have their trigger guard removed or repositioned as to not impair use with large cold weather gloves on, especially those intended to be used in cold weather conditions, and the Trigger Assembly 7 is preferred to provide enough room without further adjustment such that the Finger 1 can contact Shield 2 on the top or bottom, or both, or not contact Shield 2 as desired.

Figure 5:
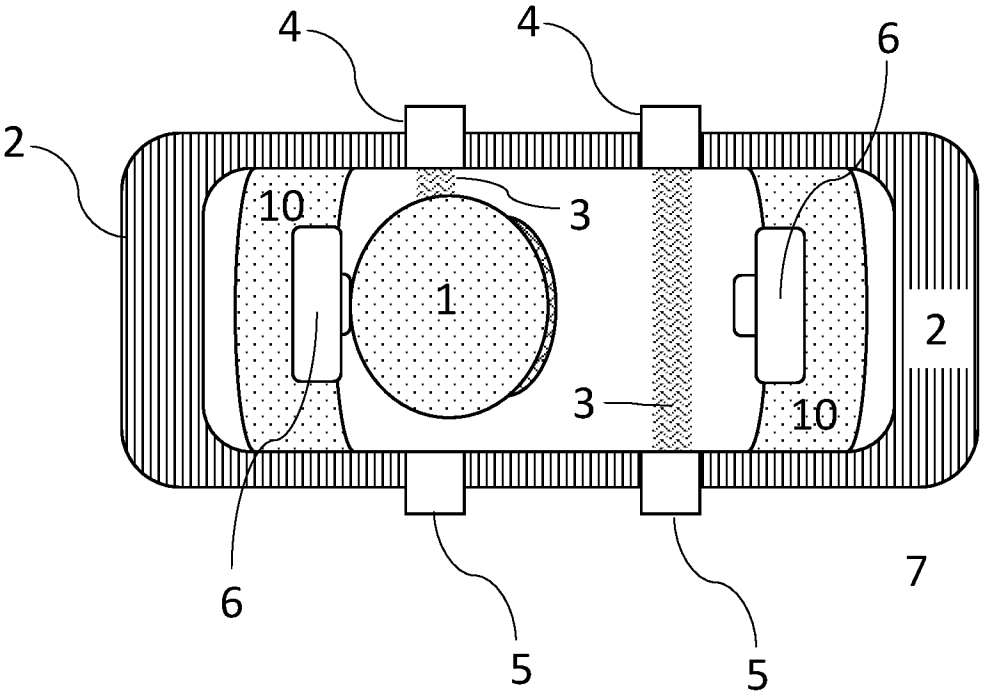
FIG. 5 illustrates a further aspect of the present invention incorporated into the Trigger Assembly 7 having two each of Beam 3.

FIG. 5 illustrates a further aspect of the present invention incorporated into the Trigger Assembly 7. Here Trigger Assembly 7 is comprised of individual components including Shield 2, two each Fire 3, two each Emitter 4, two each Receiver 5, two each Switch 6 and two each Switch Adjust 10.

A Finger 1 is shown resting against the left Switch 6. The Finger 1 is shown pointing out of the FIG. 5 towards the reader, the fingernail shown on the Finger 1 towards the right Fire 3.

Initially the Fire 3 beams are inactive and Firearm 12 will not discharge. When Finger 1 presses either of the Switch 6 the Fire 3 beams becomes active.

The motion of Finger 1 causing discharge as shown when moving forward is opposite the squeezing motion usually associated with the operation of a firearm's trigger. Finger 1 may start at either end of Trigger Assembly 7 and in this manner inherent safety, improved accuracy and shooter preference are all provided by the present invention.

Discharge is initiated through the function of one or both of the Fire 3 and is configurable in a number of manners selectable for the particular implementation of the present disclosure.

In one scenario the left Switch 6 is pressed by Finger 1 activating both of the Fire 3 as emitted by the respective Emitters 4 and received by the respective Receivers 5. The left Fire 3 is blocked by Finger 1 and the Right Fire 3 is not blocked. In the initial state no signal is sent by Trigger Assembly 7 and the weapon does not discharge. The Finger 1 moves to the right unblocking the left Fire 3 causing a signal to be sent by the Trigger Assembly 7 and the weapon discharges. The Finger 1 may then move left breaking Fire 3 and the weapon receives a signal to discharge or not discharge as desired, or may move to the right breaking the right Fire 3 initiating another discharge or not as desired. The Finger 1 may press the right Switch 6 and turn off the Trigger Assembly 7 or may move to the left making the right Fire 3 allowing another discharge of the weapon. In this manner four discharges may be made in a controllable manner with one Finger 1 movement forward and back across the Trigger Assembly 7. This motion of Finger 1 may start and stop at either side Trigger Assembly 7 producing the desired operation. In another scenario the Trigger assembly 7 may be configured to cause a discharge of the weapon only when a Fire 3 is broken and made, facilitating one or more discharges on each action.

One or both of the Switch Adjust 10 may be fixed in Shield 2 as facilitates the implementation of the present disclosure but are otherwise preferred to be adjustable within the Shield 2 to accommodate the preferences of the shooter. Switch Adjust 10 is preferred to slide for positioning within Shield 2 and to be firmly positioned by means such as a fastener or slide stop as desired. Once each Switch Adjust 10 is positioned, the shooter is provided with suitable start and stop positions for Finger 1 with interruption or completion of either or both of Fire 3 being convenient for the implementation of the present disclosure. The two Switch Adjust 10 define the range of motion for Finger 1 and are preferred to be position adjustable or fixed within Shield 2. The two Switch Adjust 10 define the range of motion of Finger 1 within the Shield 2 and Finger 1's interaction with Fire 3 as emitted by Emitters 4 and received by Receivers 5.

It is a further preferred embodiment that the spacing and positioning of the Emitters 4 and Receivers 5 be adjustable or fixed as suits the implementation of the present disclosure and their function in relation to discharge sequence be determined by the application.

Figure 6:
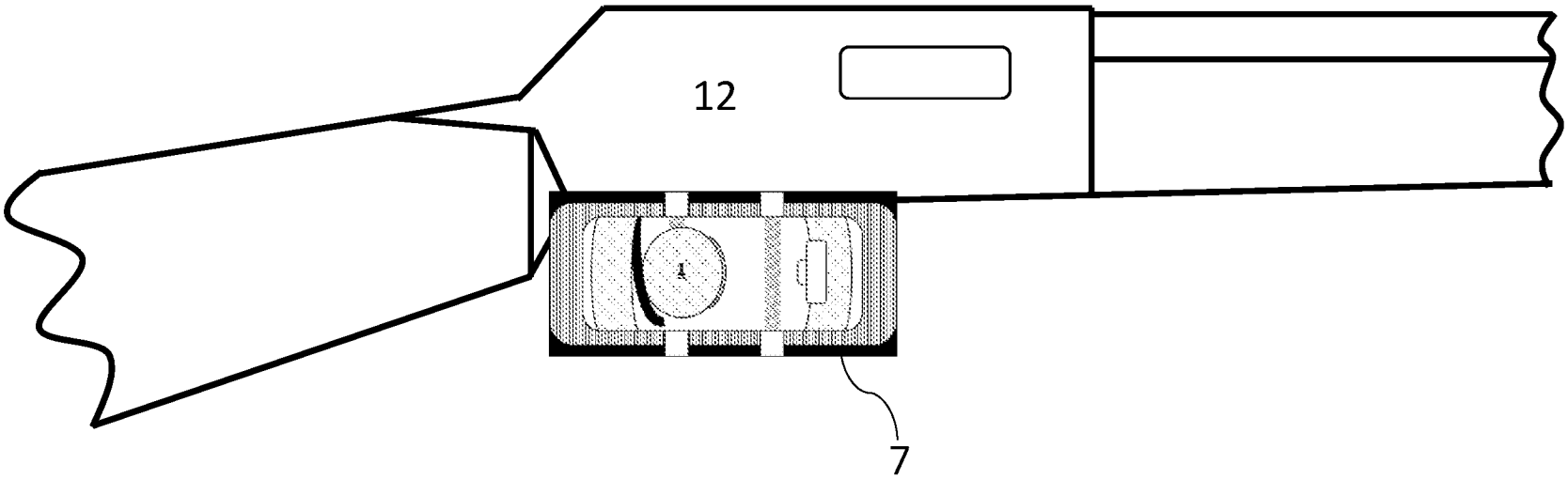
FIG. 6 illustrates a Trigger Assembly 7 arranged as per FIG. 5 mounted on a Firearm 12, in this case a long firearm such as a rifle or shotgun.

FIG. 6 illustrates the Trigger Assembly 7 mounted as per FIG. 5 as the Trigger Assembly 7 on a Firearm 12. The left Switch 6 is in the form of a conventional firearm trigger to accommodate feel for the shooter. Either of both of the Switch 6 are preferred to be configured as suits the desired operation or feel for the shooter. Firearm 12 is shown as a long firearm such as a rifle or shotgun. Switch 6 is arranged to be easily accessed by the shooter and is readily depressed as the Firearm 12 is held in a conventional shooting stance by the shooter.

Switch 6 is preferred to be mounted in Shield 2 to arm or disarm Firearm 12 as part of the typical operation of the shooter. The present invention is further configurable to maintain a no fire condition to accommodate random finger motion during recoil assuring safety after firearm discharge and during firearm recoil. In this manner the ability of the Trigger Assembly 7 to change state is momentarily disallowed upon discharge and the Finger 1 is required or not required, as determined by the desired operation, to return to the previous state in order to continue the action and process of the Trigger Assembly 7. The time allotted is controlled by Electronics 20 (not shown) and is preferred to be settable as desired buy the shooter or pre-set as per the preferred application.

Trigger Assembly 7 is further configurable to emulate the various conventional trigger mechanisms to include single stage triggers. A single stage trigger ideally has no movement before releasing at their set weight, moving only far enough rearward to release the sear. The present invention, through adjustment of the Switch Adjust 10 and the location of the relevant Fire 3, may be activated by initiating the Switch 6 and moving the Finger 1 a small distance emulating a single stage trigger and initiating discharge without any trigger pressure on the firearm.

Another mechanical trigger in common use is the two-stage trigger. The present invention provides for similar operation through initiation of the Trigger Assembly 7 by Switch 6 as the first stage, and the second stage to fire the weapon being accomplished by the Finger 1 movement.

The third type of mechanical trigger mechanism is known as a 'set trigger'. This type of trigger is found on older style European or reproduction black powder rifles. The present invention is preferred to be configured to facilitate the same action as desired with the maximum pressure to set and the discharge the firearm being reduced to zero.

Figure 7:
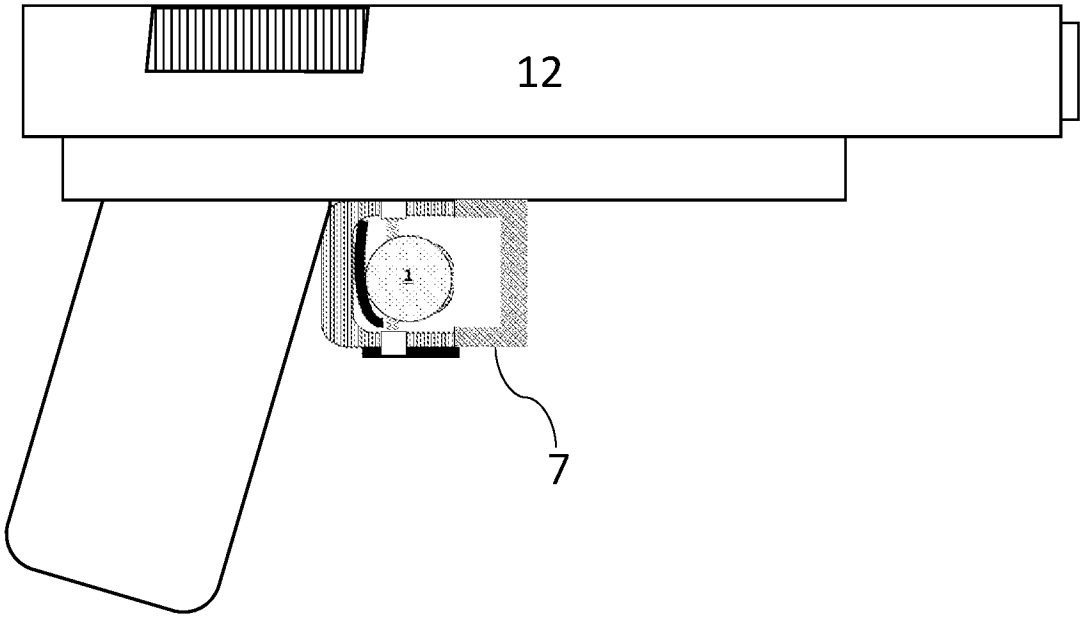
FIG. 7 illustrates a Trigger Assembly 7 arranged as per FIG. 3 implemented on a Firearm 12, in this case a handheld firearm such as a pistol.

FIG. 7 illustrates a Trigger Assembly 7 arranged as per FIG. 3 implemented on a Firearm 12, in this case a hand firearm such as a pistol. Trigger Assembly 7 in its various embodiments is applicable to any type or class of firearm.

Figure 8:
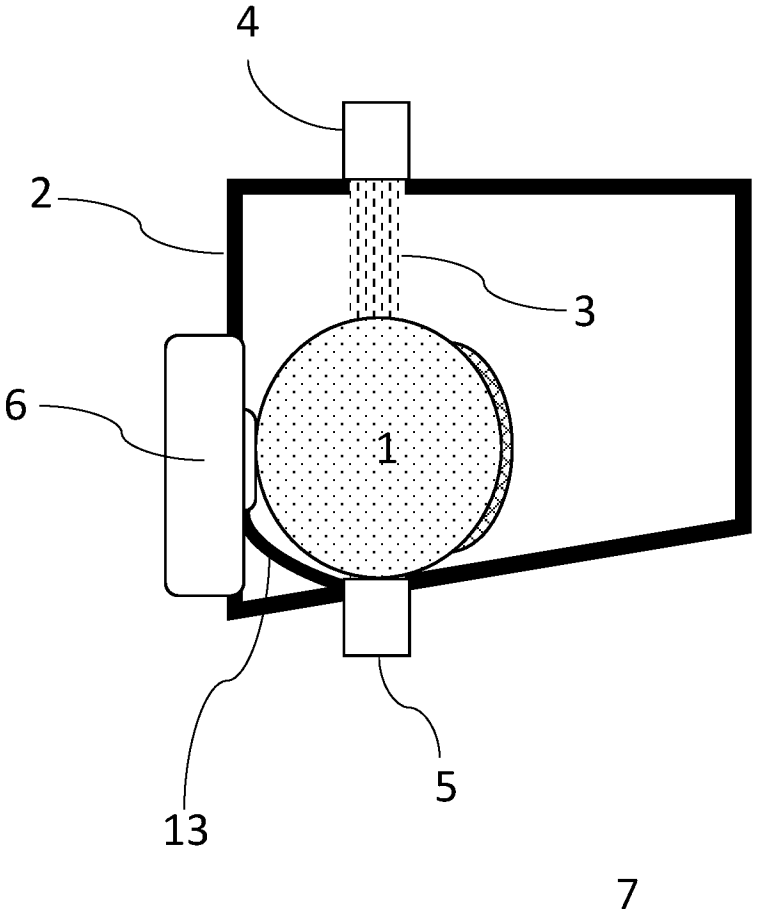
FIG. 8 illustrates a Trigger Dip 13.

FIG. 8 illustrates a further aspect of the present invention incorporating a Trigger Dip 13. Trigger Dip 13 facilitates Finger 1 naturally resting against Switch 6 and blocking Fire 3 as emitted by Emitter 4. The Trigger Dip 13 is preferred configured both as a separate or integrated component of Shield 2, and functions as a resting place for the Finger 1 regardless of the design or manufacture of Shield 2. Trigger Dip 13 accommodates Finger 1 resting on Switch 6 by proving an inclined and resting surface for Finger 1. Firearm 12 discharges whenever Finger 1 allows Fire 3 to illuminate Receiver 5. The Firearm 12 may be configured to continuously discharge as long as Fire 3 illuminates Receiver 5, or may behave in any manner as configured for the particular implementation of the present disclosure.

Figure 9:
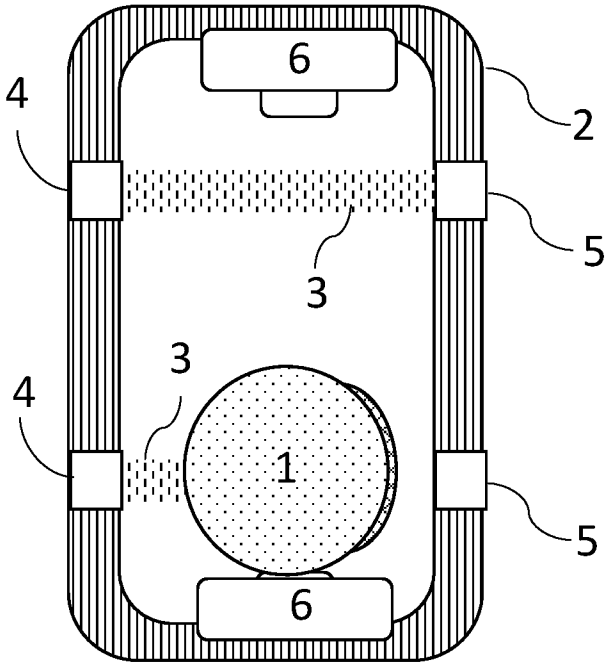
FIG. 9 illustrates the present invention showing a vertically aligned Trigger Assembly 7.

FIG. 9 illustrates a further aspect of the present invention showing Finger 1 resting against the lower Switch 6 blocking the lower Fire 3. The two Fire 3, two Emitter 4, two Receiver 5, and two Switch 6 are mounted in Shield 2. A Finger 1 is shown resting against the lower Switch 6 at the bottom of the vertically configured Shield 2. The Finger 1 is shown pointing out of the frame of reference towards the reader, the fingernail shown on the top, on the right, of the Finger 1 and towards the lower Receiver 5. Finger 1 moves vertically within Shield 2 and discharges Firearm 12 when Fire 3 is no longer broken, or is allowed to complete discharge as configured. Each cycle of Fire 3 is selectable to cause a discharge one or more times as herein detailed. The Firearm 12 may be configured to continuously discharge as long as Fire 3 is uninterrupted or interrupted as desired.

Figure 10:
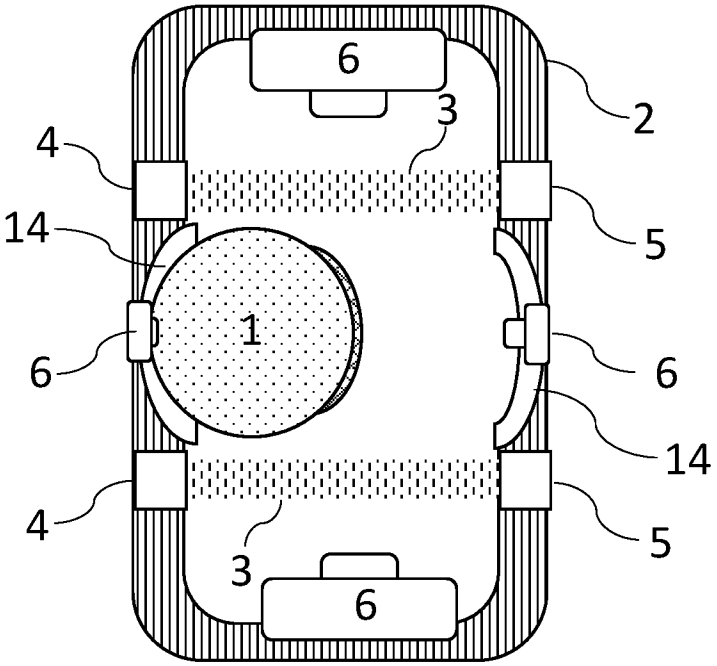
FIG. 10 illustrates the present invention showing a vertically aligned Trigger Assembly 7 with multiple beams and multiple switches.

FIG. 10 illustrates a further aspect of the present invention showing Finger 1 resting against the left Finger Position 14 not blocking either Fire 3. The two Fire 3, two Emitter 4, two Receiver 5, and four Switch 6 are mounted in Shield 2. In this configuration the Finger 1 movement in the vertical plane blocks or unblocks the respective Fire 3. As Finger 1 moves vertically within Shield 2 Firearm 12 discharges when Fire 3 is broken or no longer broken, or is allowed to complete discharge as configured. Each cycle of Fire 3 is selectable to cause a discharge one or more times as herein detailed. The Firearm 12 may be configured to continuously discharge as long as Fire 3 is interrupted or uninterrupted as desired.

Figure 11:
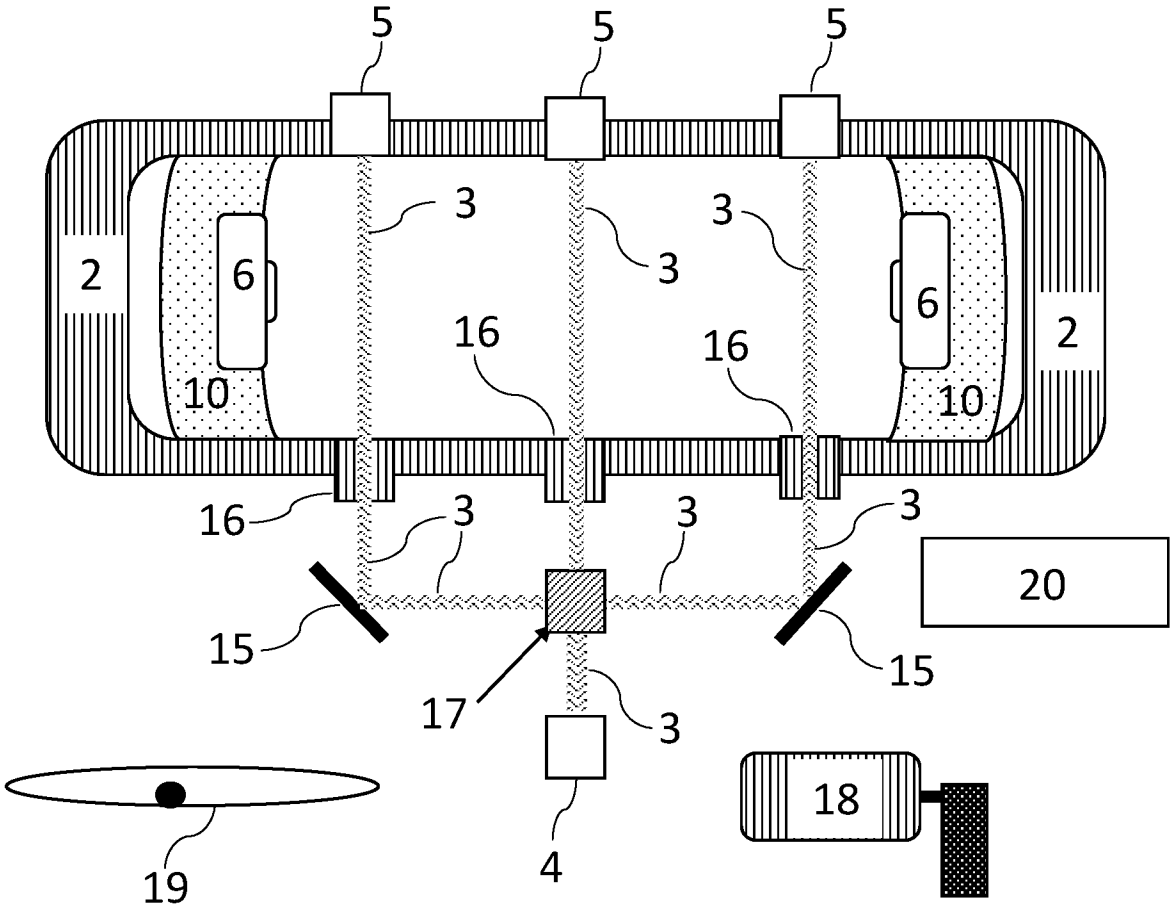
FIG. 11 illustrates detailed aspects of the present invention including electronics, sensory feedback and an angle detector.

FIG. 11 illustrates a further aspect of the present invention and is comprised of two Switch Adjust 10, a single Fire 3 divided into three beams, Emitter 4, three Receivers 5, Shield 2, two Switch 6, two Reflectors 15, Vibrator 18, Beam Splitter 17, three Beam Windows 16, Electronics 20, and Angle Detector 19. The Emitter 4 emits Fire 3, Fire 3 is split into three Fire 3 beams by Beam Splitter 17, the Fire 3 beams intersecting two Reflectors 15 and are reflected through two Beam Windows 16 illuminating two Receivers 5, the center Fire 3 passing through the center Beam Window 16 and illuminating the center Receiver 5. The Vibrator 18 is active providing tactile feedback to the shooter that the firearm is in a dischargeable condition whenever Emitter 4 is active. Conversely, three Emitter 4 could be joined and received by a single Receiver 5.

It is a preferred embodiment that the weapon be equipped with a Microelectromechanical system, herein indicated as Angle Detector 19, to include an Inertial Navigation system or device with corresponding data recording and transmission systems or devices providing location, position, and orientation of the weapon singly or in any combination of real or near real time. It is a preferred embodiment that Angle Detector 19 be an electronically readable level. It is a further preferred embodiment that the Microelectromechanical system be any applicable technology or device to include Gimballed gyrostabilized platforms, Fluid-suspended gyrostabilized platforms, Strapdown systems, Motion-based alignment, Vibrating gyros, Hemispherical resonator gyros, Quartz rate sensors, Magnetohydrodynamic sensors, MEMS gyroscope, Ring Laser Gyros, Fiber optic gyros, Pendular accelerometers, Timing & Inertial Measurement Unit sensors, Quantum Accelerometers, and other devices capable of providing location information at an acceptable rate for the preferred implementation of the present disclosure. It is a preferred embodiment that the data be recorded and transmitted as required during the entirety of the weapon's operation.

Electronics 20 is preferred as an electronic and/or integrated software or programmable controller that controls electronic functions and devices. Angle Detector 19 detects the location, horizontal pointing vector and vertical angle and motion of the Firearm 12 and provides information to Electronics 20 which determines the fire or no fire condition of the Firearm 12 for the particular geometric and location situation for the particular implementation of the present disclosure as a safety function when desired. It is a further preferred embodiment that the determined manner of Trigger Assembly 7 initiating discharge of Firearm 12 be selectable by the shooter.

Many combinations of discharge control may be accomplished with the present disclosure.

In the case of a single beam, an example operation of the present invention begins by holding the Firearm 12 and pressing the Switch 6 in the Trigger Assembly 7. The Vibrator 18 starts to vibrate providing tactile feedback to the shooter that the Firearm 12 is active, and the Fire 3 beam or beams are on. As long as a Fire 3 beam is interrupted by Finger 1 the Firearm 12 remains armed and ready. When Finger 1 moves and unblocks the Fire 3 beam the Firearm 12 discharges. When Finger 1 again blocks the Fire 3 beam the Firearm 12 returns to a ready state. When Finger 1 moves and again unblocks the Fire 3 beam the Firearm 12 discharges. When Finger 1 again blocks the Fire 3 beam the Firearm 12 returns to a ready state. When Finger 1 presses the Switch 6 the Trigger Assembly 7 shuts down and the Firearm 12 will no longer fire.

A scenario with multiple Fire 3 beams can begin by holding the Firearm 12 and pressing the Switch 6 in the Trigger Assembly 7. The Vibrator 18 begins providing tactile feedback to the shooter that the Firearm 12 is active, and the multiple Fire 3 beams are on. As long as any Fire 3 beam is interrupted the Firearm 12 remains armed and ready. When Finger 1 moves and unblocks any Fire 3 beam the Firearm 12 discharges. When Finger 1 enters the previous or another Fire 3 beam the Firearm 12 enters a ready state. When Finger 1 moves and unblocks the Fire 3 beam the Firearm 12 discharges. Every time Finger 1 enters and exits a Fire 3 beam the Firearm 12 discharges. When Finger 1 presses any Switch 6 the Trigger Assembly 7 shuts down and the Firearm 12 will no longer fire.

Another scenario may begin by holding the Firearm 12 and pressing the Switch 6 in the Trigger Assembly 7. The Vibrator 18 begins providing tactile feedback to the shooter that the Firearm 12 is active, and the multiple Fire 3 beams are on. As long as a Fire 3 beam is interrupted the Firearm 12 remains armed and ready. When Finger 1 moves and unblocks any Fire 3 beam the Firearm 12 discharges. When Finger 1 enters the previous or another Fire 3 beam the Firearm 12 discharges. When Finger 1 moves and unblocks or blocks any Fire 3 beam the Firearm 12 discharges. When Finger 1 presses any Switch 6 the Trigger Assembly 7 shuts down and the Firearm 12 will no longer fire. In this manner a Finger 1 movement may actuate multiple discharges of the weapons as desired.

Another scenario can begin by holding the Firearm 12 and pressing the Switch 6 in the Trigger Assembly 7. The Vibrator 18 starts to vibrate providing tactile feedback to the shooter that the Firearm 12 is active, and the multiple Fire 3 beams are active. As long as a Fire 3 beam is interrupted the Firearm 12 remains armed and ready. When the Finger 1 moves and unblocks a Fire 3 beam the Firearm 12 discharges and continues to discharge repeatably. When the Finger 1 moves and blocks any Fire 3 beam the Firearm 12 stops discharging. When the Finger 1 presses any Switch 6 the Trigger Assembly 7 shuts down and the Firearm 12 will no longer fire. In this manner full auto fire is facilitated.

The independent Receiver 5 may be preferred to independently act to produce single or multiple discharge in any manner as desired providing a complete range of possible configurations as controlled by Electronics 20.

Many other scenarios are possible and all combinations and scenarios are preferred embodiments of the present invention.

The Vibrator 18 provides haptic feedback to include tactile and/or audio feedback to the shooter whenever the Trigger Assembly 7 is active and the Firearm 12 is therefore in a dischargeable condition. It is a preferred embodiment that haptic feedback of any type be utilized to inform the shooter that the weapon is active and in a dischargeable condition. Haptic feedback is often generated by action of a vibration motor. The two current types of vibration motors in common use are an eccentric rotating mass vibration motor and a linear resonant actuator. The rotating mass vibration motor uses an unbalanced mass on a DC motor's shaft that rotates and creates an off center, outwardly acting, often know as centrifugal, force that translates to vibrations. The linear resonant actuator contains a small internal mass, usually attached to a spring that is driven, translating a mass reactive force due to acceleration into vibrations into whatever it is attached to. Such actuators are specifically designed and commonly used for haptic feedback applications, often having rise and stop times improved by specialized electronic driving techniques.

The Beam Splitter 17 and Mirrors 11 are preferred to be such items as are commonly available. Alternatively, light guides fabricated from cast acrylic materials such as polymethylmethacrylate that typically have a 90% optical transmission efficiency and offer good mechanical properties are a preferred embodiment taking the place of Beam Splitter 17 and Mirrors 11. Other means and methods of distributing or turning or directing or conducting a light beam may be used and do not detract from the novelty of the present disclosure.

Figure 12:
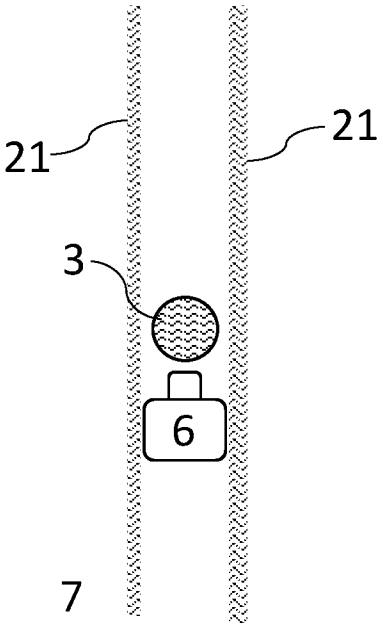
FIG. 12 illustrates a further aspect of the present invention and is comprised of a Fire 3, Switch 6, and Finger Position Beam 21 detector.

FIG. 12 illustrates a further aspect of the present invention seen in the vertical looking down upon a horizontally held Trigger Assembly 7 and is comprised of a Fire 3, Switch 6 and a Finger Position Beam 21. Finger Position Beam 21 provides detection of the position of Finger 1 (not shown) by the Finger 1 (not shown) blocking or not blocking Finger Position Beam 21 as determined by the particular configuration. Finger Position Beam 21 is configured relative to Shield 2 such that Finger Position Beam 21 interacts with Finger 1 (not shown) indicating proper or improper positioning of Finger 1 (not shown) in the Shield 2. The Finger Position Beam 21 is preferred to be either a single beam provided for the entire shield 2, or multiple independent Finger Position Beams 21 as required for the particular application.

Figure 13:
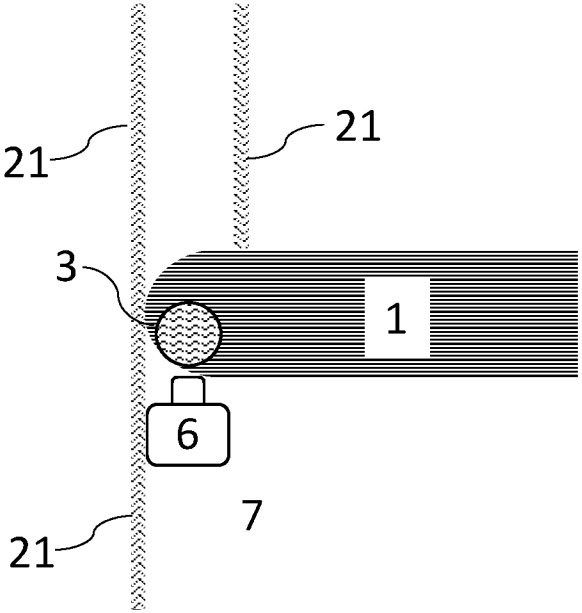
FIG. 13 illustrates a further aspect of the present invention and is comprised of a Fire 3, Switch 6, and Finger Position Beam 21 detector being interrupted by a Finger 1 facilitating operation of Trigger Assembly 7.

FIG. 13 illustrates a further aspect of the present invention seen in the vertical looking down upon a horizontally held Trigger Assembly 7 and is comprised of a Fire 3, Switch 6, Finger 1 and a Finger Position Beam 21. Finger Position Beam 21 provides detection of the position of Finger 1 by the Finger 1 blocking or not blocking Finger Position Beam 21 as determined by the particular configuration. Finger 1 is shown blocking Fire 3 and the right side of the FIG. 13 Finger Position Beam 21 while the left Finger Position Beam 21 is not blocked by the Finger 1 indicating an improper positioning of Finger 1 placing the Trigger Assembly 7 into a non-dischargeable condition.

Figure 14:
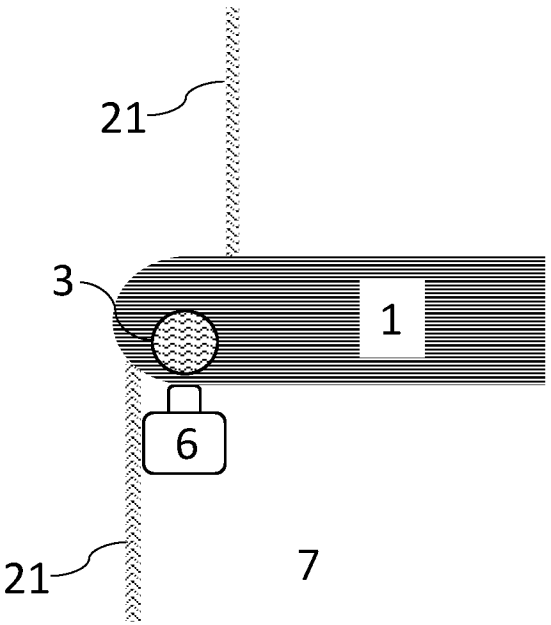
FIG. 14 illustrates a further aspect of the present invention and is comprised of a Fire 3, Switch 6, and Finger Position Beam 21 detector being only partially interrupted by Finger 1 disallowing operation of Trigger Assembly 7.

FIG. 14 illustrates a further aspect of the present invention seen in the vertical looking down upon a horizontally held Trigger Assembly 7 and is comprised of a Fire 3, Switch 6, Finger 1 and a Finger Position Beam 21. Finger Position Beam 21 provides detection of the position of Finger 1 by the Finger 1 blocking or not blocking Finger Position Beam 21 as determined by the particular configuration. Finger 1 is shown blocking Fire 3 and the right Finger Position Beam 21 while the left Finger Position Beam 21 is also block by the Finger 1 indicating a proper positioning of Finger 1 and placing the Trigger Assembly 7 into a dischargeable condition.

The term Firearm refers to a firearm of any type to include all known rifles, hand firearms, specialty and military firearms. The terms Firearm and Firearms as used herein also include all devices that direct energy against a target by any means to include throwing a projectile, using compressed gas or other means, and by directing energy to a target through any means to include liquid, solid, gas, granular, pellets, mechanical, inertial, radiative energy and other means.

It is a preferred embodiment of the present invention that no mechanical trigger force be required during the discharge of the firearm thereby avoiding the introduction of aiming error. It is a further preferred embodiment of the present invention that tactile and other sensory device and methods be incorporated as required to provide location and other sensory feedback to the shooter.

The terms optical and light as used through this disclosure refer to all emitted waves of any frequency or mode of generation, transmission or reception to include electromagnetic waves of any frequency, and to further include all visible, near and far infrared, infrared, ultraviolet, optical and other optical, and radio waves, and all mechanical waves of any type and frequency to include any and all sound waves regardless of their mode of generation, transmission, carrier or method of reception, and all mechanical forces and means of generation and reception.

Unless otherwise defined, all terms (including trade, technical and scientific terms) used herein have the same meaning as commonly understood by one of ordinary skill in the art to which this invention belongs. The terms gun and firearm are used interchangeably both in the singular and plural forms. The terms discharge and fire are used interchangeably both in the singular and plural forms. It is further understood that terms, such as those defined in commonly used dictionaries, should be interpreted as having a meaning that is consistent with their meaning in the context of the specification and relevant art, and should not be interpreted in an idealized or overly formal sense unless expressly so defined herein. Well known functions and common constructions are not described for brevity.

We claim:

1. A firearm, comprising:

a shield coupled to the firearm, the shield having a vertical arm integral with an upper horizontal arm and a lower horizontal arm;

an emitter positioned on one of the horizontal arms of the shield;

a receiver positioned on the other horizontal arm of the shield and in physical alignment with the emitter;

a switch on the vertical arm of the shield, the switch configured to toggle when depressed by a finger, when the switch is toggled, the emitter emits radiated energy and the finger is located between the emitter and receiver, blocking the radiated energy between the emitter and receiver, and when the finger is removed from between the emitter and the receiver, the firearm is configured to discharge.

2. The firearm of claim 1, wherein when the finger is moved from between the emitter and the receiver, the radiated energy is incident on the receiver, which causes the firearm to discharge.

3. The firearm of claim 1, wherein the shield is a trigger guard.

4. The firearm of claim 1, wherein the shield aligns the emitter and the receiver.

5. The firearm of claim 1, wherein the shield protects the switch.

6. The firearm of claim 1, wherein the emitter is a light-emitting diode (LED) semiconductor light source releasing energy in the form of photons.

7. The firearm of claim 6, wherein the LED emitted energy is in the visible, ultraviolet, or infrared wavelengths.

8. The firearm of claim 6, wherein the LED is a laser diode.

9. The firearm of claim 1, wherein the receiver is a photodiode a phototransistor, or a transistor.

10. The firearm of claim 1, wherein when the receiver is an NPN (negative, positive, negative) transistor or a PNP (positive, negative, positive) transistor biased by the incoming light from the emitter.

11. The firearm of claim 1, wherein the receiver further comprises a filter allowing only frequencies of the signal generated by the emitted to be detected by the receiver.

12. The firearm of claim 1, wherein the emitter and the receiver are synchronized by a data stream containing start and stop data.

13. The firearm of claim 1, wherein the emitter and the receiver facilitate an analog-to-digital conversion allowing variable readings to be detected by the receiver.

14. The firearm of claim 1 wherein the radiated energy is in the form of electromagnetic or optical emission of any frequency form, wavelength, pulse or intensity.

15. The firearm of claim 1, wherein the shield, the switch, the emitter, and the receiver are coated with low reflectivity materials.

16. The firearm of claim 1, wherein the switch is any type of state selection device to include a switch comprising electrical, electronic, mechanical, pressure, or optical switch suitable for the sensing and signaling of a desired state change of the firearm.

17. The firearm of claim 1, wherein the switch provides tactile or other sensory feedback to assure operation is confirmed to a shooter.

18. The firearm of claim 1, further including a timer, wherein the switch being pressed initiates the timer, and after a predetermined time, if the firearm has not discharged, then the ability to cause discharge of the firearm is disabled.

* * * * *